United States Patent [19]

Gehly et al.

[11] Patent Number: 5,032,962

[45] Date of Patent: Jul. 16, 1991

[54] REDUNDANT LAMP MECHANISM

[75] Inventors: Joel Gehly, McKean; David Zolner, Fairview; David Mackowski, North East, all of Pa.

[73] Assignee: American Sterilizer Company, Erie, Pa.

[21] Appl. No.: 495,246

[22] Filed: Mar. 16, 1990

[51] Int. Cl.[5] ..... F21V 19/04

[52] U.S. Cl. ..... 362/254; 362/20; 362/804

[58] Field of Search ..... 362/20, 254, 232, 804

[56] References Cited

U.S. PATENT DOCUMENTS

| | | | |
|---|---|---|---|
| 1,915,081 | 6/1933 | Berg | 362/254 |
| 1,987,532 | 1/1935 | Koito | 362/20 |
| 4,225,901 | 9/1980 | Luce | 362/254 |
| 4,458,179 | 7/1984 | Bainbridge et al. | 315/88 |
| 4,734,625 | 3/1988 | Geanous et al. | 315/313 |

OTHER PUBLICATIONS

Pamphlet-CHROMOPHARE Models C959 and C570, "A new era in surgical lighting", Martin (not date given).

*Primary Examiner*—Stephen F. Husar

*Attorney, Agent, or Firm*—Kirkpatrick & Lockhart

[57] ABSTRACT

A mechanism for positioning one of a plurality of lamps, each carried by a lamp socket, at a desired focal point of an optical system is comprised of a first lamp socket positioned in an operative position such that a lamp carried by that socket will be at a desired focal point of the optical system. At least one other lamp socket is positioned in an inoperative position. A mechanism for enabling movement of the first lamp socket from the operative position to an inoperative position while simultaneously moving the other lamp socket from the inoperative position to the operative position is provided. The present invention enables a failed lamp to be replaced by a backup lamp in such a manner that no degradation or change in optical performance occurs.

8 Claims, 4 Drawing Sheets

REDUNDANT LAMP MECHANISM

BACKGROUND OF THE INVENTION

1. Field of the Invention

The present invention is directed generally to optical systems and more particularly to optical systems having more than one light source.

2. Cross Reference to Related Application

The present application is related to U.S. patent application Ser. No. 495,236, filed concurrently herewith, entitled Redundant Lamp Control Circuit, and assigned to the same assignee as the present invention.

3. Description of the Prior Art

In various types of optical systems it is desirable to have multiple or redundant lamps. The provision of redundant lamps enables the optical system to continue functioning in the event that the primary lamp should fail. Such a feature is particularly desirable in, for example, surgical lights.

In U.S. Pat. No. 4,734,625, a control circuit is disclosed which controls the operation of electric lights. The control circuit may be used in conjunction with a surgical light including a lamp having two filaments. Each filament may be arranged so that it provides an illumination pattern of a different type. In the event one of the filaments fails, the good filament is automatically energized thereby enabling the light to continue operation. Although such a light can continue operating in the event of a filament failure, the pattern for which the failed filament was responsible can no longer be used.

Another example of a controller used for controlling the operation of a multi-filament lamp is found in U.S. Pat. No. 4,458,179.

Another way to address the problem is to provide multiple lamps rather than lamps having multiple filaments. A surgical light utilizing multiple lamps is sold by Martin under the trademark CHROMOPHARE. The CHROMOPHARE lights sold under model nos. C950 and C570 are equipped with auxiliary lamps. Should a lamp burn out, a relay switch energizies one of the auxiliary lamps.

Whether a light is provided with a lamp having multiple filaments or multiple lamps, in either case, the light will not perform in exactly the same manner as with the primary filament or the primary lamp because the backup light source is not at the same focal point. Even the very small change associated with energizing a different filament within the same lamp results in light being produced from a source which is not located at the desired position. Therefore, some compromise in operating characteristics must be made to enable the optical system to continue operating. Thus, the need exists for an optical system which can remain operational with no loss or change in optical characteristics upon the failure of the main light source and energization of a backup light source.

SUMMARY OF THE INVENTION

The present invention in its broadest form is directed to a mechanism for positioning one of a plurality of lamps, each carried by a lamp socket, at a desired focal point within an optical system. A first lamp socket is positioned in an operative position so that a lamp carried by that socket will be at the desired focal point of the optical system. At least one other lamp socket is provided which is positioned in an inoperative position that does not interfere with the usable flux produced by the first lamp. Means are provided for enabling the movement of the first lamp socket from the operative position to an inoperative position while simultaneously moving the other lamp socket from the inoperative position to the operative position. In that manner, upon failure of the primary lamp carried in the first lamp socket, a secondary lamp carried in the other lamp socket can be positioned at the same focal point in the optical system at which the primary lamp was located. That enables the optical system to continue operation without any loss or change in the optical characteristics of the system.

According to one embodiment of the present invention, the means for enabling the above-described movement includes a base member, a first link rotatably connected between the first lamp socket and the base member, and a second link rotatably connected between the other lamp socket and the base member. A drive link having a base portion rotatably connected to the base member, a first arm portion rotatably connected to the first lamp socket, and a second arm portion rotatably connected to the other lamp socket is positioned between the first and second links. A hand crank defines an output shaft. A pivot arm has a first end connected to the output shaft and a second end connected to the drive link.

The mechanism of the present invention enables a failed primary lamp to be removed from the desired focal point of the optical system. Simultaneously, an energized backup lamp can be moved to the focal point of the system previously occupied by the primary lamp. That enables the lamp to continue operating with virtually no loss or change in optical characteristics. These and other advantages and benefits of the present invention will become apparent from the following Description of a Preferred Embodiment.

BRIEF DESCRIPTION OF THE DRAWINGS

For the present invention to be clearly understood and readily practiced, a preferred embodiment will now be described, by way of example only, with reference to the accompanying figures wherein.

DESCRIPTION OF A PREFERRED EMBODIMENT

Figure 1:
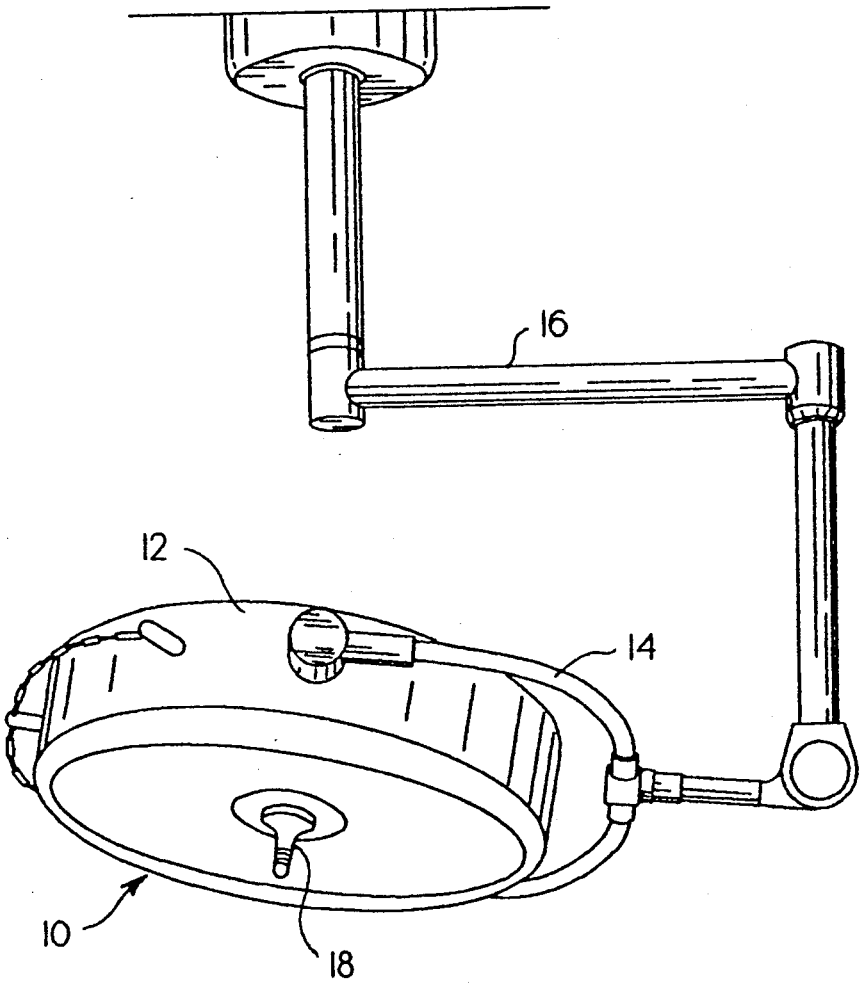
FIG. 1 illustrates a typical surgical light and suspension system.

The mechanism of the present invention may be used in conjunction with a surgical light 10 such as that shown in FIG. 1. The reader will understand that although the present invention will be described in connection with the surgical light of FIG. 1, the present invention may be used in conjunction with other types of optical systems.

The surgical light 10 illustrated in FIG. 1 is comprised of an outer cover 12 which is connected to a yoke 14 as is known. The yoke 14 is connected to a suspension system 16 which, together with the yoke 14, provides several degrees of freedom for the surgical light 10. A sterile handle support 18, designed to support a removable sterile handle cover (not shown), is provided in the center of the surgical light 10 so that the surgeon or sterile nurse may manipulate the surgical light 10 to the desired position.

Figure 2:
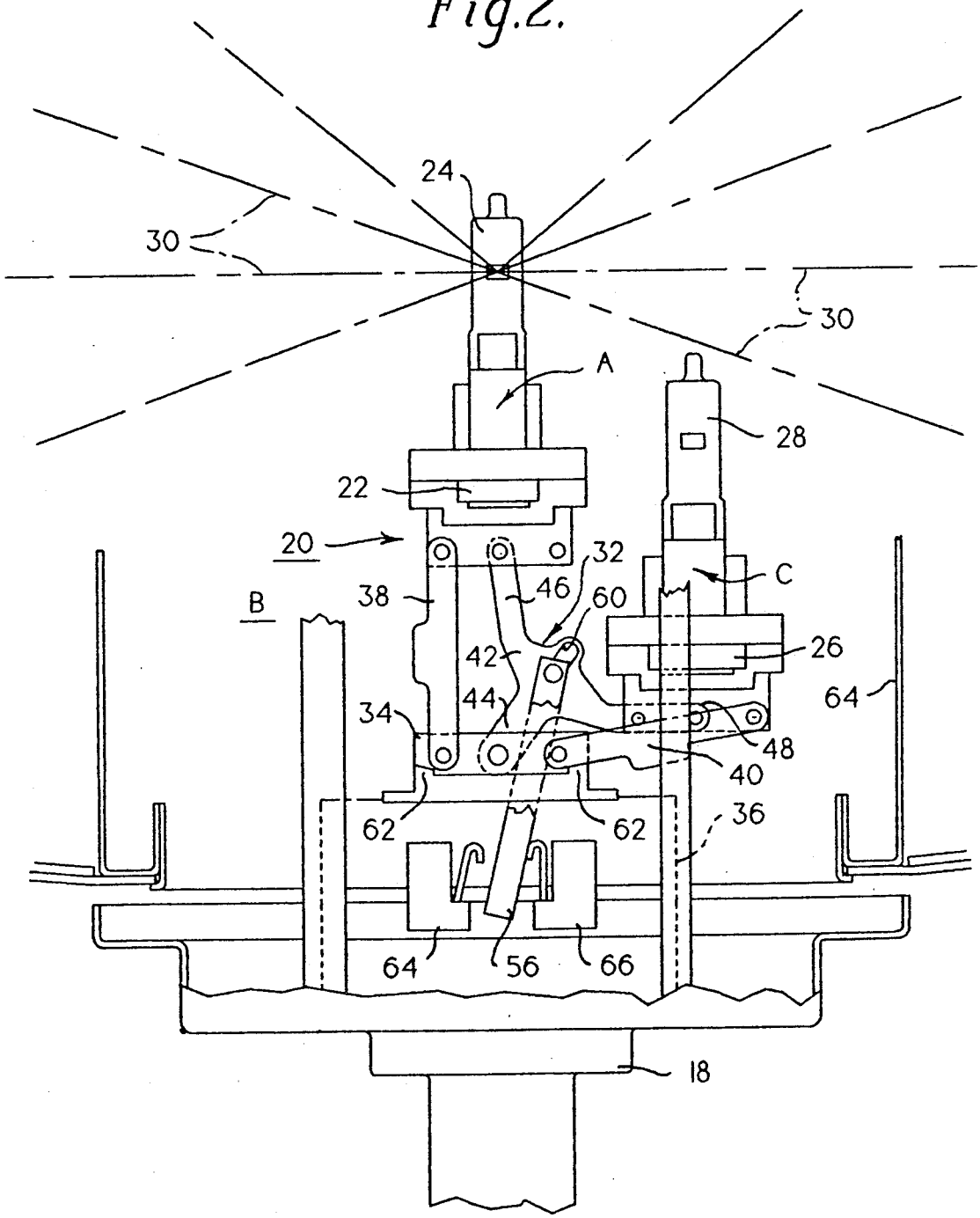
FIG. 2 illustrates the redundant lamp change mechanism of the present invention.

The redundant lamp mechanism 20 of the present invention may be located above the sterile handle support 18 as seen in FIG. 2. The mechanism is comprised of a first lamp socket 22 shown in an operative position A so that a lamp 24 carried by the socket 22 is at a desired focal point of the optical system. A second lamp socket 26 is provided which carries a second lamp 28. As shown in FIG. 2, the second socket 26 is in an inoperative position C. The redundant lamp mechanism 20 of the present invention is designed to place a single lamp, for example, lamp 24, at the desired focal point A of the optical system while the second non-energized lamp 28 is in non-operative position C. The non-operative position C is in close proximity to the desired operating position A but lies outside of the useful light flux 30 produced by the lamp 24.

Should lamp 24 fail, means are provided, designated generally by the reference numeral 32, for effecting movement of the lamp 28 from the inoperative position C to the operative position A while the failed lamp 24 simultaneously moves from the operative position A to an inoperative position B. As the lamp 28 moves into the operative position A, it may come into engagement with any suitable type of electrical contacts (not shown), which are positioned to energize whichever lamp is in the operative position A. Because the lamp 28 now occupies the same position previously occupied by the lamp 24, the lamp 28 provides 100% optical performance. The present invention, therefore, provides optical control optimization of a single lamp system with a second spare lamp within the light that can provide 100% optical performance even after a primary lamp failure.

The means 32 for effecting the above-described movement is comprised of a base member 34 rigidly connected to the sterile handle support 18 through a member 36. A first link 38 is rotatably connected at one end to the base member 34 and rotatably connected at the other end to the lamp socket 22.

Figure 3:
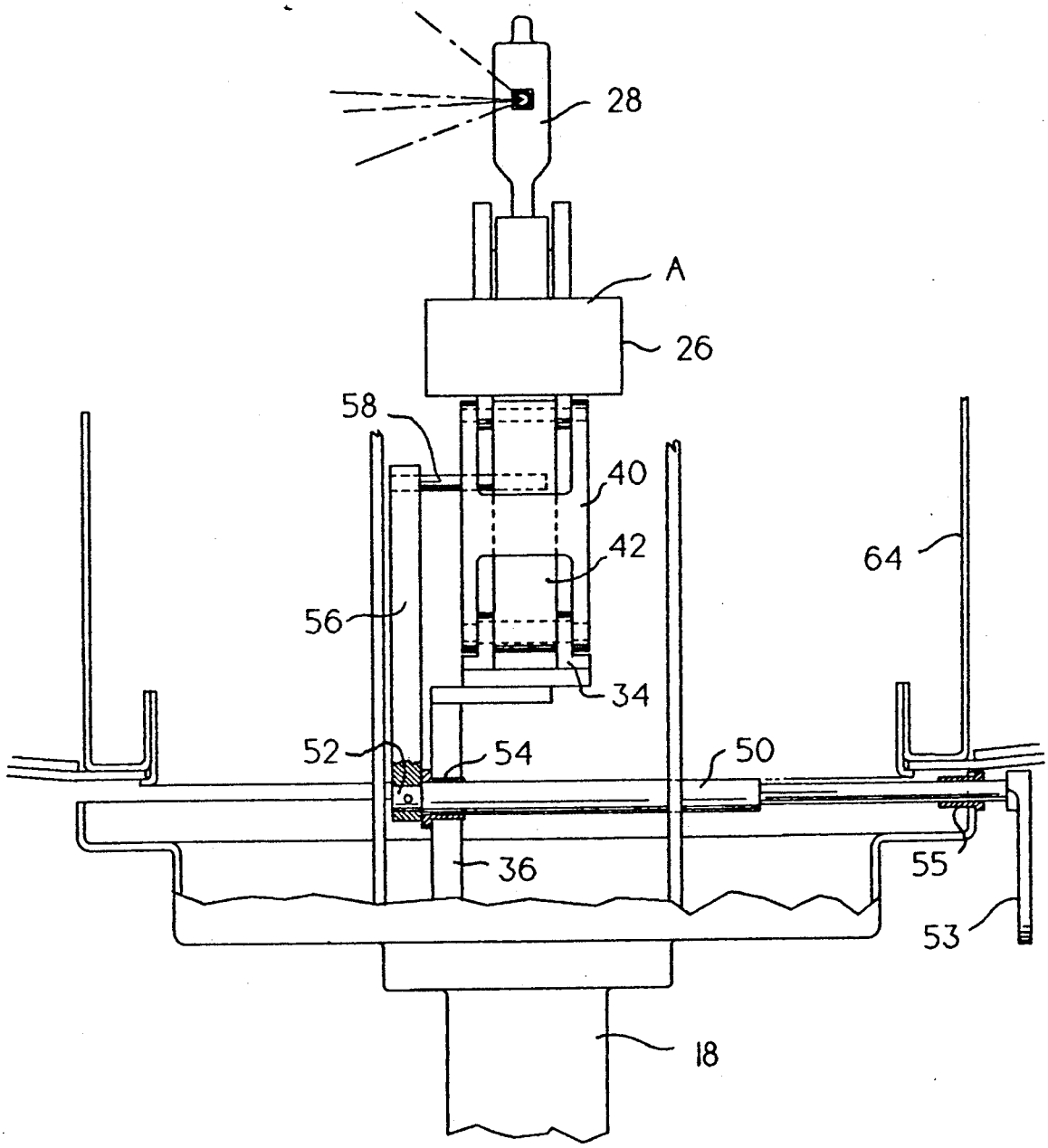
FIG. 3 is a view of the mechanism as viewed from the right in FIG. 2 but with lamp 26 in the operative position.

A second link 40 is rotatably connected at one end to the base member 34 and rotatably connected at the other end to the lamp socket 26. The first link 38 and second link 40 are identically shaped and each is substantially H-shaped as seen best in FIG. 3. FIG. 3 is a view from the right side of the mechanism illustrated in FIG. 2 but with lamp 28 rotated into position A.

Located between the first link 38 and second link 40 is a center drive link 42. The center drive link 42 has a base portion 44 rotatably connected to the base member 34. The center drive link 42 has a first arm portion 46 rotatably connected to the first lamp socket 22 and a second arm portion 48 rotatably connected to the second lamp socket 26.

Figure 4:
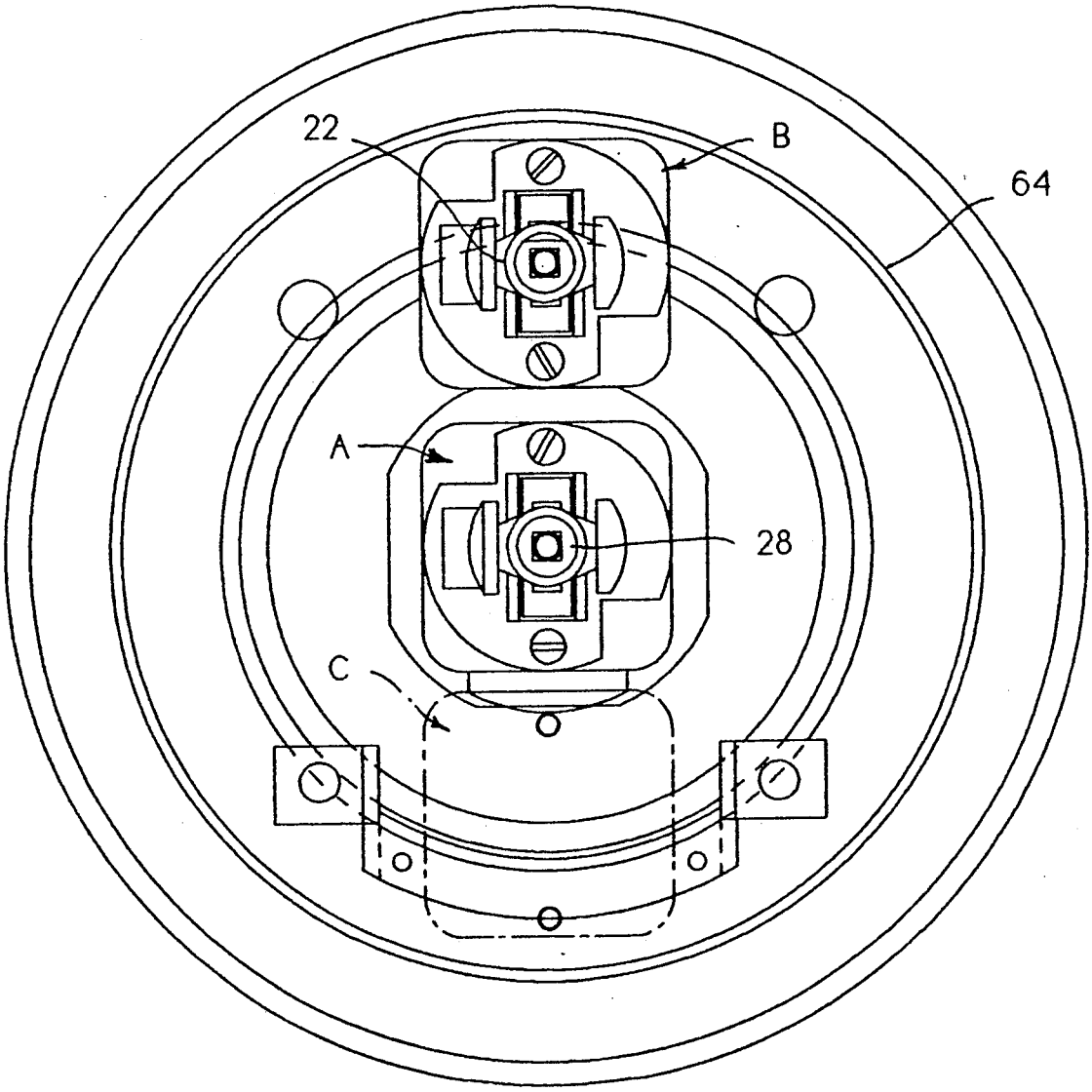
FIG. 4 is a top view looking down on the mechanism shown in FIG. 3.

Means are provided for driving the center drive link 42 between a first position shown in FIG. 2 in which the first lamp socket 22 is in the operative position A while the second lamp socket 26 is in the inoperative position C and a second position illustrated in FIGS. 3 and 4 in which the first lamp socket 22 is in the inoperative position B while the second lamp socket 26 is in the operative position A. When the center drive link 42 is in the first position, the connection point of the base portion 44 to the base member 34 and the connection point of the first arm portion 46 to the first lamp socket 22 lie on the center line of the first lamp socket 22. When the center drive link 42 is in the second position, the connection point of the base portion 44 to the base member 34 and the connection point of the second arm 48 to the second lamp socket 26 lie on the center line of the second lamp socket 26.

The means for diving the drive link may be either a hand crank 50 or an electric motor not shown but disclosed in the aforementioned copending U.S. patent application Ser. No. 495,236, which is hereby incorporated by reference. As seen in FIG. 3, the hand crank 50 is retained by the member 36 and the sterile handle support 18. The hand crank 50 has an output shaft 52 extending through a bushing 54 and an operating lever 53 extending through a bushing 55. Rotation of operating lever 53 causes rotation of the shaft 52 which is transferred to the center drive link 42 through a pivot arm 56.

The pivot arm 56 is connected at a first end to the shaft 52 and has a pivot pin 58 extending from a second end. The pivot pin 58 fits within a slot 60 formed in the center drive link 42. The slot 60 is provided to accommodate pivot pin 58 as the center link 42 moves from the first position to the second position. Stops 62 are located on the base member 34 to limit the travel of the first and second links 38 and 40, respectively. The entire mechanism 20 is located within the optical core 64.

When the center drive link 42 is driven, either manually or by a motor, simultaneous movement of the lamps 24 and 28 with respect to each other is effected. The failed lamp which is at the desired focal point A is rotated out of that position while the good lamp is rotated from one of the non-operative positions B or C (depending upon the orientation of center drive link 42 at the time of lamp failure) into the operative position A. It is anticipated that the first and second links 38 and 40 and the center drive link 42 may be sized such that when the center drive link moves from the first to the second position, each of the lamps 24 and 28 travels a horizontal distance of approximately 1.75 inches (4.44 cm) and a vertical distance of approximately 1.5 inches (3.81 cm). Thus, the spare lamp is maintained in close proximity to the desired focal point but does not interfere with the useful flux 30 being produced by the primary lamp. That enables the spare lamp to be moved quickly and efficiently to the desired focal point of the optical system. Once so positioned, the optical system performs in exactly the same way as before the primary lamp failed.

It may be desirable to add springs (not shown) to insure that the first link 38 and second link 40 seat tightly against stops 62. That may be accomplished by adding a spring in tension between the connection point of the base portion 44 to the base member 34 and the connection point of the first arm portion 46 to the first lamp socket 22. A second spring in tension may be provided between the connection point of the base portion 44 to the base member 34 and the connection point of the second arm portion 48 to the second lamp socket 26.

While the present invention has been described in connection with an exemplary embodiment thereof, it will be understood that many modifications and variations will be readily apparent to those of ordinary skill in the art. This disclosure and the following claims are intended to cover all such modifications and variations.

What is claimed is:

1. A mechanism for positioning one of a plurality of lamps carried by a plurality of lamp sockets at a desired focal point of a surgical light, comprising:

a first lamp socket positioned in an operative position so that a lamp carried by said socket will be at desired focal point of the surgical light;

at least one other lamp socket positioned in an inoperative position outside of the flux produced by a lamp carried by said first lamp socket; and means for enabling the movement of said first lamp socket from said operative position to an inoperative position outside of the flux produced by a lamp carried by said other lamp socket while simultaneously moving said other lamp socket from said inoperative position to said operative position.

2. A mechanism for positioning one of a plurality of lamps carried by a plurality of lamp sockets at a desired focal point of an optical system, comprising:

a first lamp socket positioned in an operative position so that a lamp carried by said socket will be at a desired focal point of the optical system;

at least one other lamp socket positioned in an inoperative position;

a base member;

a first link rotatably connected between said first lamp socket and said base member;

a second link rotatably connected between said other lamp socket and said base member;

a drive link having a base portion rotatably connected to said base member, a first arm portion rotatably connected to said first lamp socket, and a second arm portion rotatably connected to said other lamp socket, said drive link being positioned between said first and second links; and means for driving said drive link to enable the movement of said first lamp socket from said operative position to an inoperative position while simultaneously moving said other lamp socket from said inoperative position to said operative position.

3. A mechanism for positioning a lamp within an optical system, comprising first lamp socket means assuming one of an operative and an inoperative position;

second lamp socket means assuming one of the same operative position and an inoperative position;

a base member;

a first link rotatably connected between said first lamp socket means and said base member;

a second link rotatably connected between said second lamp socket means and said base member;

a drive link having a base portion rotatably connected to said base member, a first arm portion rotatably connected to said first lamp socket means, and a second arm portion rotatably connected to said second lamp socket means, said drive link being positioned between said first and second links; and means for driving said drive link between a first position in which said first lamp socket means is in said operative position while said second lamp socket means is in said inoperative position and a second position in which said first lamp socket means is in said inoperative position while said second lamp socket means is in said operative position.

4. The mechanism of claim 3 wherein said means for driving said drive link includes a hand crank having an output shaft and a pivot arm having a first end connected to said output shaft and a second end connected to said drive link.

5. The mechanism of claim 4 additionally comprising a pivot pin extending from said second end of said pivot arm, and wherein said drive link has a slot centrally located between said first and second arm portions for receiving said pivot pin.

6. The mechanism of claim 3 wherein said base member has stops formed therein to restrict the rotation of said first and second links.

7. The mechanism of claim 3 wherein the connection point of said base portion and said base member and the connection point of said first arm portion and said first lamp socket means lie on the center line of said first lamp socket means when said first lamp socket means is in said operative position.

8. The mechanism of claim 7 wherein the connection point of said base portion and said base member and the connection point of said second arm portion and said second lamp socket means lie on the center line of said second lamp socket means when said second lamp socket means is in said operative position.

* * * * *

UNITED STATES PATENT AND TRADEMARK OFFICE

CERTIFICATE OF CORRECTION

PATENT NO. : 5,032,962

DATED : July 16, 1991

INVENTOR(S) : Joel C.Gehly, David Zolner and David Mackowski

It is certified that error appears in the above-identified patent and that said Letters Patent is hereby corrected as shown below:

The title page,

Col. 2, line, in " other Publications", delete "not" and substitute --no-- therefor Col.5, line 6, before "desired", insert --a--.

Signed and Sealed this

Twenty-fourth Day of November, 1992

*Attest:*

DOUGLAS B. COMER

*Attesting Officer*

*Acting Commissioner of Patents and Trademarks*